US006367852B1

(12) United States Patent
Aspenwall

(10) Patent No.: US 6,367,852 B1
(45) Date of Patent: Apr. 9, 2002

(54) SLIDING DOORS LOCK HINGE

(75) Inventor: John E. Aspenwall, Lehi, UT (US)

(73) Assignee: Jahabow Industries, Inc., Owensville, MO (US)

( * ) Notice: Subject to any disclaimer, the term of this patent is extended or adjusted under 35 U.S.C. 154(b) by 0 days.

(21) Appl. No.: 09/487,901

(22) Filed: Jan. 19, 2000

(51) Int. Cl.[7] ..... E05C 19/08
(52) U.S. Cl. ..... 292/285; 292/281; 292/DIG. 46
(58) Field of Search ..... 70/99; 292/256.75, 292/258, 263, 278, 281, 285, DIG. 46

(56) References Cited

U.S. PATENT DOCUMENTS 1,566,662 A * 12/1925 Fairland ..... 292/281
1,956,651 A 5/1934 Moran
2,629,619 A * 2/1953 May ..... 292/281
3,693,293 A 9/1972 Egan
4,198,785 A 4/1980 Marulic
4,633,615 A 1/1987 Moose
5,076,531 A * 12/1991 Delaney ..... 248/552
5,154,459 A * 10/1992 Cochran ..... 292/258
5,605,365 A * 2/1997 George ..... 292/263
6,053,547 A * 4/2000 Lemieux ..... 292/281

* cited by examiner

*Primary Examiner*—S. Joseph Morano
*Assistant Examiner*—Andrew D. Wright
(74) *Attorney, Agent, or Firm*—M. Reid Russell

(57) ABSTRACT

A sliding doors lock hinge for maintaining a pair of sliding doors together at their overlapping ends that includes first and second door end mounts that are hinge connected and formed to fit over the opposing door ends and the second door end mount includes a hinged hasp strap that has a slot therein to pass over a tab that is secured to an outer face of a forward door frame end. The tab can be fix or is pivot mounted to the frame face and includes a hole therethrough for receiving an end of a padlock shackle fitted therethrough and locked in the padlock body. The first door end mount is formed from a section of channel to fit over an inner door frame end and has a side wall that is common with the second door end mount, and the edge of which common side is hinge connected to a nose end plate to fit over a door frame end that, in turn, is hinge connected, at its opposite end, to the end of the hasp strap, and which end plate and hasp strap preferrably include sections of pading material secured to their door end engaging surfaces.

6 Claims, 3 Drawing Sheets

SLIDING DOORS LOCK HINGE

BACKGROUND OF THE INVENTION

1. Field of the Invention

This invention relates to locking mechanisms for maintaining overlapping sliding door ends together and in particular to independent locks that can be easily installed and removed from overlapping sliding doors ends.

2. Prior Art

Locking arrangements for maintaining sliding door ends together are, of course, not new and examples of pairs of track mounted sliding doors that, when closed, have their ends aligned, in side by side relationship are shown in U.S. Patents to Moran, U.S. Pat. No. 1,956,651 and to Egan, et al., U.S. Pat. No. 3,693,293. Which arrangements the hinge lock of the invention is for use with. Whereas, door arrangements where only one door is arranged to slide relative to another door or window, with the door ends to butt against one another are not suitable for locking together by the hinge lock of the invention. Such door arrangements are shown in U.S. Patents to Marulic, et al., U.S. Pat. No. 4,198,785 and to Moose, U.S. Pat. No. 4,633,615. Accordingly, it should be understood, the invention is useful for maintaining overlapping door ends together to include the doors of the cited Moran and Egan, et al., patents but is unlike the lock configurations of these patents.

SUMMARY OF THE INVENTION

It is a principal object of the present invention to provide a lock for maintaining a pair of sliding doors together at their overlapping ends.

Another object of the present invention is to provide an independent sliding doors hinge lock assembly that includes a removable hinge assembly arranged to fit over both sliding doors ends and including a hinge connected strap that can be pivoted to travel over a tab that is secured to extend outward from a door frame end, where, with the strap positioned over the tab, the tab is to received a conventional pad lock shackle fitted therethrough.

Still another object of the present invention in a sliding doors hinge lock is to provide a first and second door end mounts that are pivotally connected together and are for individually fitting over the side by side sliding door ends, which second door end mount includes a hasp having a hinged strap that is to be pivoted over a tab that extends outwardly from a frame surface of a second door end and is to receive an open end of a shackle of a conventional padlock fitted therethrough.

Still another object of the present invention in a sliding doors hinge lock is to provide, as a removable lock, first and second hinge components that are pivotally connected together and are easily fitted to and removed from adjacent sliding door ends for quickly and conveniently locking the door ends together.

Still another object of the present invention is to provide a sliding doors hinge lock arrangement that is inexpensive to produce, is easy to install and will reliably maintain two overlapping sliding door ends together.

The invention is in a sliding doors hinge assembly for operation with a tab mounted to a door frame end surface. The assembly includes hinge connected first and second door end mounts, with the first mount formed from a section of channel of a size to fit over an inner door frame end. The first and second mounts share an inner side of the channel that has a forward edge connected by a hinge connection to a flat second mount nose end that is sized to fit over a door frame end. Which nose end has its opposite end connected by a hasp hing to a hasp strap that includes a slot opening formed therethrough. The hasp strap slot is to fit over the tab that includes a hole therethrough that is to receive an outer end of a conventional pad lock shackle. The shackle has an outer end that is closed into and locked within a padlock case or body. The first and second mounts are each for fitting over the adjacent sliding door ends to hold the door ends together, prohibiting their being move across one another until the padlock shackle is unlocked and removed from the tab hole.

DESCRIPTION OF THE DRAWINGS

In the drawings that illustrate that which is presently regarded as the best mode for carrying out the invention.

DETAILED DESCRIPTION

Figure 1:
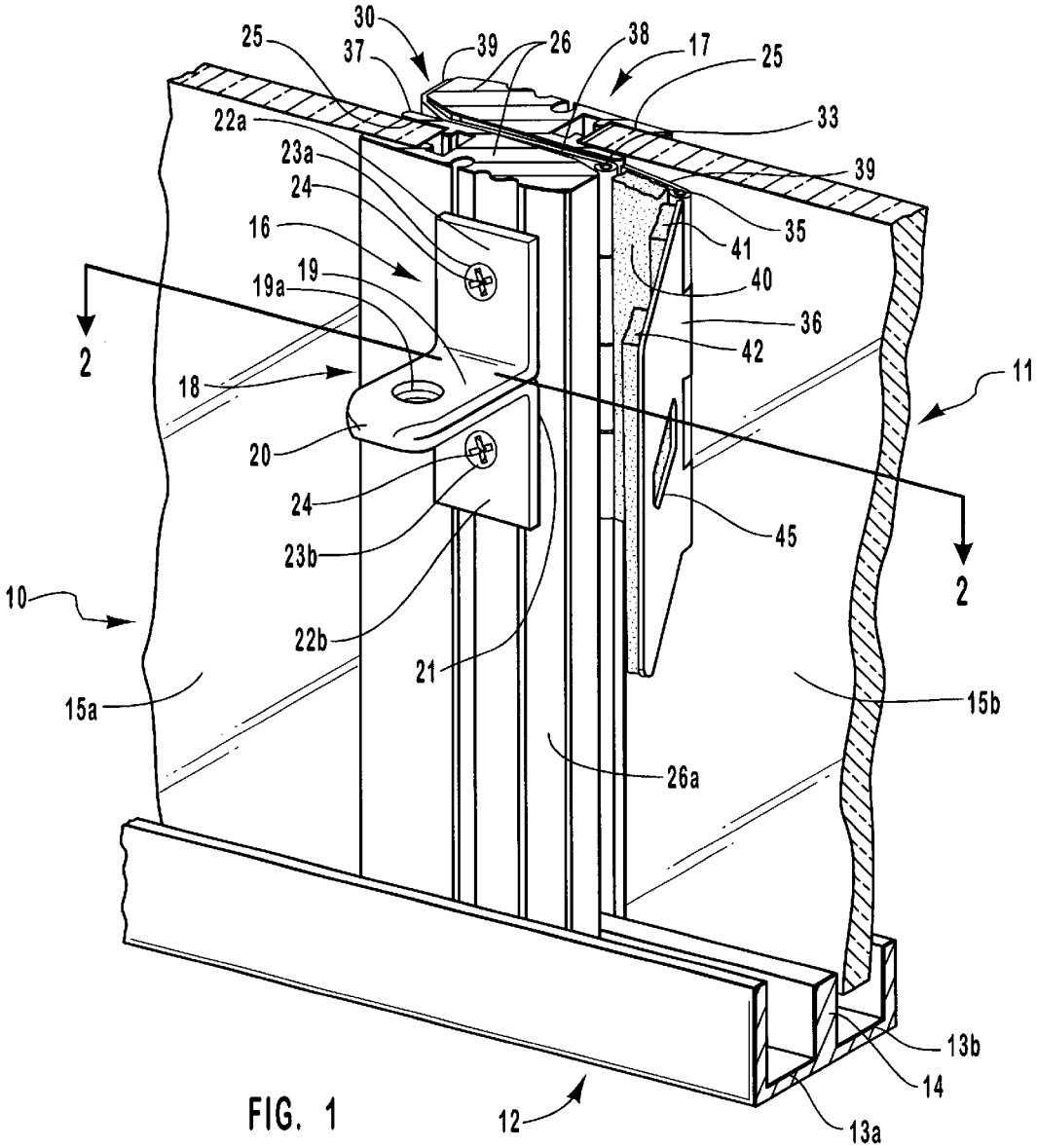
FIG. 1 is a side elevation perspective view of end portions of a pair of sliding doors that are maintained in a section of a double channel track and showing an end of an inner or rear door as having recived a first end mount of a hinge lock of the invention slid thereover and showing a second end mount as including a hasp strap that has been pivoted away from a tab mounted onto a face of an end section of an outer or forward door frame.

FIG. 1 shows a sides elevation perspective view of end sections of a pair of outer or forward and inner or rear sliding doors 10 and 11, respectively, that are fitted into, to slide along, a track 12 that includes side by side forward and rear channels 13*a* and 13*b*, respectively, that share a common side 14. The doors 10 and 11 each include a section of glass 15*a* and 15*b* and have frame ends 16 and 17 that overlap when the doors are closed. The door frames that include frame ends 16 and 17 are standard sliding door frames arranged to slide independently, and, when closed, as shown in the Figures, have their ends 16 and 17 in an overlapping attitude. One of the sliding doors 10 or 11 frame ends, as shown in the Figures, includes a tab 18 mounted thereto and extending outwardly from the frame end face 26*a*. The tab 18 is shown in FIGS. 1 through 5 formed from a single section of steel bar stock that is bent upon itself forming a blade 19 having a forward end 20 and is flared oppositely at rear end 21 into flanges 22*a* and 22*b* that have center holes 23*a* and 23*b* formed therethrough that receive metal screws 24, or like fasteners, turned therethrough, with the holes 23*a* and 23*b* to into frame end face 26*a*. FIG. 6A shows an alternative tab 18 arrangement, as discussed hereinbelow.

The door frames, shown as ends 16 and 17 in the Figures are standard sliding door frames that are preferrably formed as extrusion from aluminum and include channel sections 25 wherein ends of the glass pannels 15*a* and 15*b* are fitted. Frame end bodies 26, having opposite faces 26*a* and 26*b*, are fitted to the ends of glass pannels 15*a* and 15*b*. The frame end bodies 26 are alike and each has a forward end 27 that tapers inwardly to flat face 28.

Figure 2:
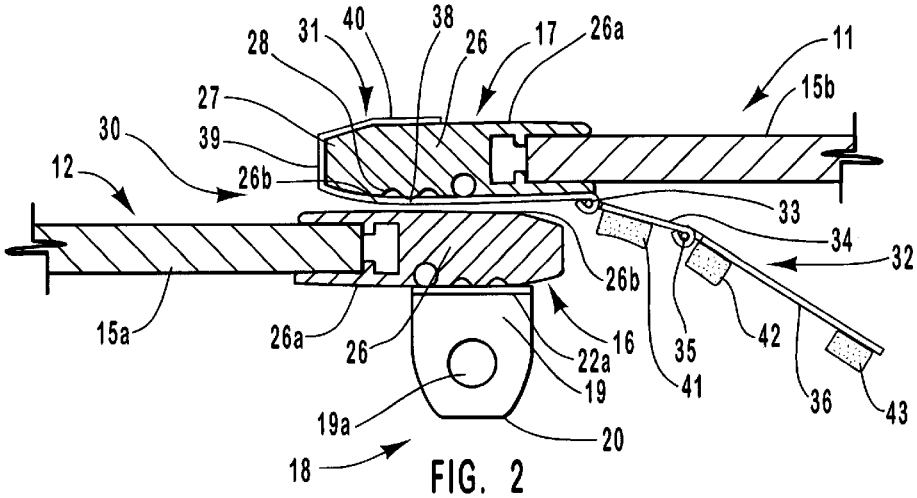
FIG. 2 is a top plan sectional view taken alongthe line 2—2 of FIG. 1

Shown in FIGS. 1 and 2 the invention includes a hinge lock 30 composed of a first door end mount 31 that is shown as a section of channel 37, and a second door end mount 32 both of which mounts are formed from steel and share a common channel 37 side wall 38. Which the side wall 38 connects to a hinge 33 of a nose end 34 of the second door end mount that includes, along an edge opposite to hinge 33, a hasp hinge 35 that, in turn, connects to a hasp strap 36. The first mount includes a tapered end 39 that rigidly connects to ends of both the common wall 38 and an outer wall 40, forming the channel. The channel of first mount 31 is formed to fit, as shown in the Figures, snuggly over a section of the inner or rear door 11 end frame 17. In which postioning the channel common wall 38 is positioned between the opposing surfaces of the frame ends 16 and 17. The second mount 32, additional to the common wall 38, includes nose end 34 that is hinged at 33 to pivot over to engage the inner door 10 frame end 17. The nose end 34, along its edge that is opposite and parallel to the hinge 33, includes a hasp hinge 35 whereto is mounted a hasp strap 36. Which nose end 34 and hasp strap 36 will pivot around the forward door frame end 16, as shown in the Figures. To provide a snug fit of the second mount 32, spacers 41, 42 and 43 are provided on, respectively, the inner face of the second mount nose end 34, and at spaced locations across the inner face of the hasp strap 36. The spacers 41, 42 and 43 are preferrably pads formed from a flexible material, such as a plastic sponge, or the like, and are each shaped as a flat rectangle and are secured, as with a layer of an adhesive, or the like, onto the respective nose end and strap inner surfaces. So arranged, the spacers 41, 42 and 43 fit closely onto the inner door 10 frame end 16 when the hasp strap 36 is closed onto, so as to pass the tab 18 through strap slot 45. So arranged, the spacers 42 and 43 stradle the tab flanges 22*a* and 22*b*, and fit against the frame end 16 outer face 26*a*.

Figure 3:
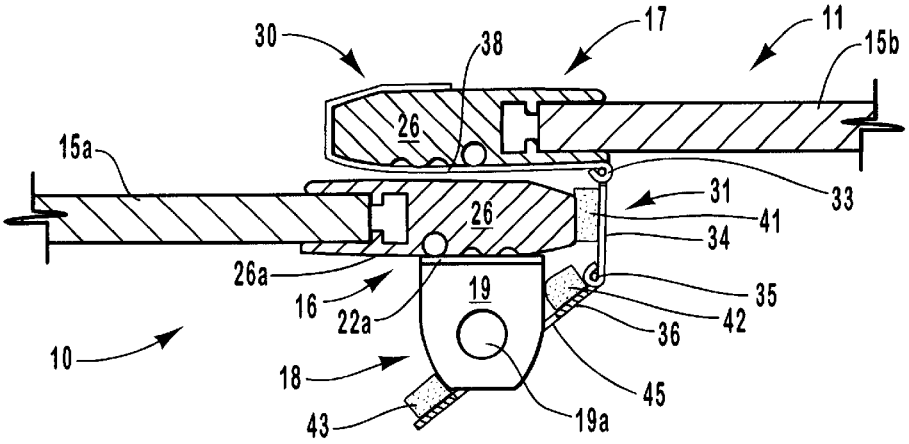
FIG. 3 is a view like that of FIG. 2 except the second end mount hasp strap is shown pivoted towards the outwardly extending tab.
Figure 4:
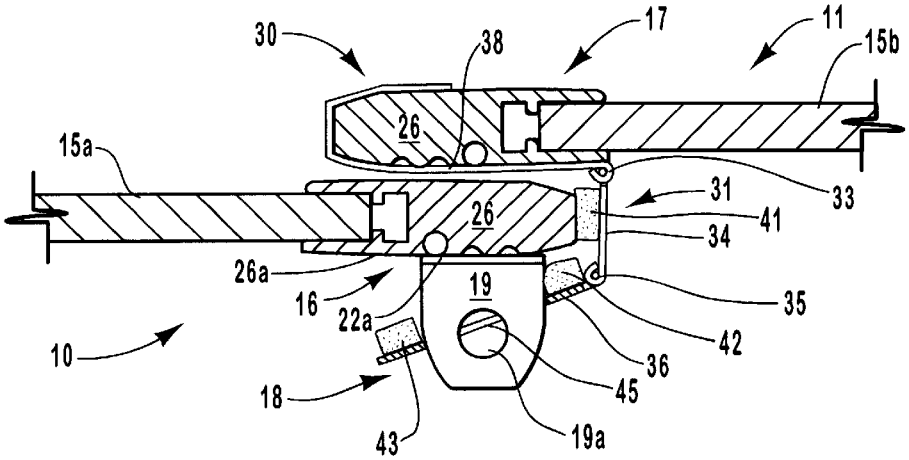
FIG. 4 is a sequential view to that of FIG. 3 showing an elongate slot or hole formed through the strap as having passed over tab outer end.
Figure 5:
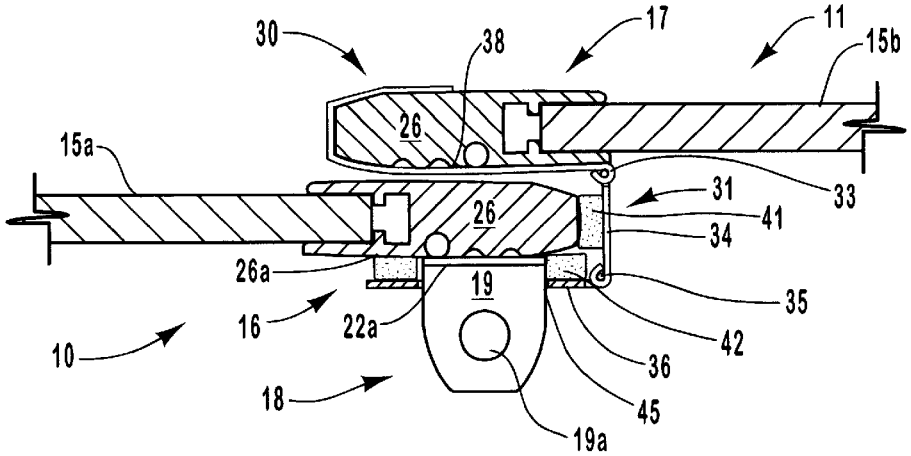
FIG. 5, is a sequential view to that of FIG. 4 showing the second end mount strap as having been fuly fitted over the tab with a rear face cushon portions of the second end mount nose end and hasp strap engaging the outer or forward door frame end section face.
Figure 6:
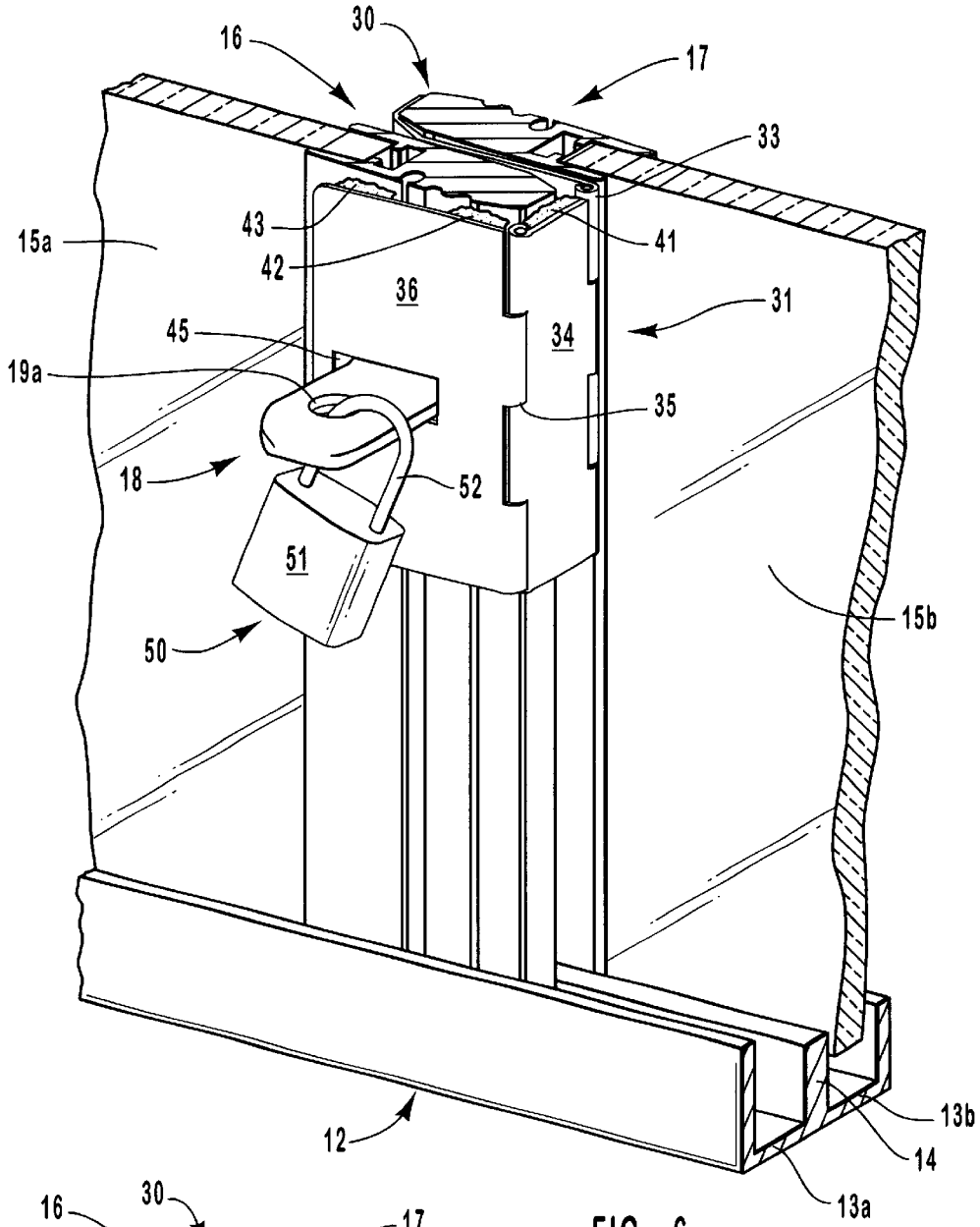
FIG. 6 is a side elevation perspective view like that of FIG. 1 showing the configuration of FIG. 5 and further including a conventional padlock having its shackle end fitted through a hole through the tab and showing the padlock as having been locked.
Figure 6A:
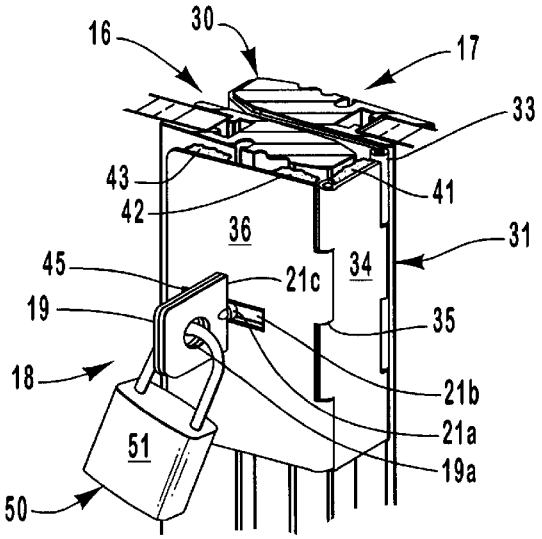
FIG. 6A is a sectional view of the hinge lock of FIGS. 1 through 6 mounted to the overlapping sliding door ends and showing the tab that is pivot mounted to the forward door face and is turned through approximately ninety (90) degrees and showing a padlock shank fitted through the tab hole and locked.

FIGS. 3 through 5 are sequential views following the view of FIG. 2, showing the forward sliding door 10 frame end 16 positioned alongside the frame end 17 of the rear sliding door 11, and alongside the common wall 38, and show the second mount 32 nose end 34 and hasp strap 36 as they pivot from the attitude shown in FIG. 2 to that shown in FIG. 5. In which FIG. 5, the hasp strap 36 is shown as having been pivoted to where the slot 45 thereof has been fully passed over the tab 18. So arranged, the respective spacers 41, 42 and 43 are shown engaging, respectively, a forward or nose end 28 of the frame end 16, and the forward face 26*a*of the frame end, spanning the tab 18. Shown in FIG. 6, a shackle 52 of a padlock 50 is fitted through the tab 18 hole 19*a* and the shackle has been urged into the packlock body 51. The padlock sharckle 52 to thereby prohibit the hasp strap 36 from traveling away from the tab 18, maintaining the respective first and second mounts 31 and 32 installed over the sliding doors frame ends 16 and 17 together, locking the doors 10 and 11 in place.

Additionally, as shown in FIG. 6A, within the scope of this disclosure, the tab 18 blade 19 can be secured with a pivot 21*a* to a plate 21*b* that is the size of and replaces the tab flanges 22*a*. The pivot 21*a* alows the tab 18 blade 19 to turn axially, as shown in FIG. 6A, approximately ninety (90) degrees or less, after the hasp strap 36 slot 45 has passed across a tab blade lower edge 21*c*. The tab blade lower edge travels across the edges of the hasp strap slot 45 to block the hasp strap 36 travel away from the tab 18, providing a releasable locking of the hasp strap and tab together. For more secure locking, the padlock 50, as shown, can be installed through the tab blade hole 19*a*.

While a preferred embodiment of my invention in a sliding doors lock hinge has been shown and described herein, it should be understood that the present disclosure is made by way of example only and that variations and changes are possible without departing from the subject matter, and reasonable equivalency thereof, coming within the scope of the following claims, which claims I regard as my invention.

I claim:

1. A sliding doors lock hinge for maintaining together a pair of forward and rear sliding doors that have been moved to where their ends overlap comprising, first and second door end mounts that are each formed to fit over each of a pair of overlapping sliding door ends and are connected by a hinge coupling along an edge of a common side, which said second door end mount includes a nose section that is hinge connected along an inner edge to said common side edge and is of a width to fit across a sliding door end, with said nose section hinge connected along an outer edge to a hasp strap that has a flat rectangular shape and has a center longitudinal slot formed therein; and a tab for mounting onto, to extend outwardly from, an outer face of the sliding door end whereover said hasp strap is pivoted, and which said tab is of a size to accomodate said hasp strap slot passed thereover and includes a hole to receive an end of a padlock shackle fitted therethrough.

2. A sliding doors lock hinge as recited in claim 1, wherein the first door end mount is a section of channel that is formed to fit over and grip onto a rear sliding door end frame; and an inner side of said channel is the the common side.

3. A sliding doors lock hinge as recited in claim 2, further including flat sections of a cushion material secured, respectively, to flat nose section and hasp strap surfaces that engage the forward sliding door end frame surfaces.

4. A sliding doors lock hinge as recited in claim 3, wherein the hasp strap receives a pair of individual cushion material sections that are each formed as a flat rectangle foam section that is to said hasp strap surface in spaced apart relationship to span the tab.

5. A sliding doors lock hinge as recited in claim 1, the first and second door end mounts and tab are formed of steel.

6. A sliding doors lock hinge as recited in claim 1, wherein the tab is pivot mounted to a plate that is secured to the window fire end outer face, and said pivot mounting is arranged to allow a blade of said tab to turn across the hasp strap slot edges when the hasp strap is fitted thereunder.

* * * * *